United States Patent [19]

Haselkorn et al.

[11] 4,347,085

[45] Aug. 31, 1982

[54] INSULATIVE COATINGS FOR ELECTRICAL STEELS

[75] Inventors: Michael H. Haselkorn, Franklin; Dannie S. Loudermilk, Middletown, both of Ohio

[73] Assignee: Armco Inc., Middletown, Ohio

[21] Appl. No.: 256,856

[22] Filed: Apr. 23, 1981

[51] Int. Cl.[3] ..... C23F 7/10

[52] U.S. Cl. ..... 148/6.16; 148/113

[58] Field of Search ..... 148/6.15 R, 6.16, 113

[56] References Cited

U.S. PATENT DOCUMENTS

| | | | |
|---|---|---|---|
| 3,832,245 | 8/1974 | Akerblom | 148/113 |
| 3,948,786 | 4/1976 | Evans | 148/6.16 |
| 3,996,073 | 12/1976 | Evans | 148/6.16 |
| 4,179,315 | 12/1979 | Miller | 148/113 |

*Primary Examiner*—Ralph S. Kendall

*Attorney, Agent, or Firm*—Frost & Jacobs

[57] ABSTRACT

An aqueous coating solution for forming an insulative coating directly on electrical steels and on steels having a mill glass thereon. The aqueous solution comprises an aluminum-magnesium phosphate premix solution and a colloidal silica solution. The premix solution also comprises from about 10 to about 45 parts by weight $Cr_2O_3$ for every 100 parts by weight $H_2PO_4^-$ calculated as $H_3PO_4$ on a water-free basis, from about 5 to about 20 parts of a compound chosen from the class consisting of boric acid, vanadium pentoxide and mixtures thereof per 100 parts $H_2PO_4^-$ calculated as $H_3PO_4$ on a water-free basis and additional $Mg^{++}$ up to that amount which will go into solution. The colloidal silica solution is present in an amount of from that amount which will form a good glass up to 40 volume percent to provide a coating solution having a premix solution to colloidal silica solution volume ratio up to 1.5:1.

17 Claims, No Drawings

INSULATIVE COATINGS FOR ELECTRICAL STEELS

TECHNICAL FIELD

The invention relates to improved insulative coatings for electrical steels, and more particularly to insulative coatings characterized by a hard, glassy nature, excellent appearance, improved moisture resistance, excellent space factor characteristics and which improve the magnetic characteristics of the electrical steels to which they are applied. The solutions from which the coatings are made may be diluted with water in such a way that the coatings may be applied to any metal surface to serve as an anti-stick coating during annealing or to prevent oxidation during an anneal.

BACKGROUND ART

As used herein and in the claims, the terms "electrical steel" and "silicon steel" relate to an alloy, the typical composition of which by weight percent falls within the following:

Carbon: 0.060% Maximum
Silicon: 4% Maximum
Sulfur and/or Selenium: 0.035% Maximum
Manganese: 0.02% to 0.4%
Aluminum: 1.0% Maximum
Boron: 0.01% Maximum
Iron: Balance While the insulative coatings of the present invention are applicable to carbon steels for electrical uses, non-oriented silicon steels and silicon steels having various orientations, they will, for purposes of an exemplary showing, be described with respect to their application to cube-on-edge oriented silicon steel.

Such silicon steel is well known in the art and is characterized by the fact that the body-centered cubes making up the grains or crystals are oriented in a position designated (110) [001] in accordance with Miller's Indices. Cube-on-edge oriented sheet gauge silicon steel has many uses, an exemplary one of which is in the manufacture of laminated magnetic cores for power transformers and the like. In such an application, the magnetic characteristics of the cube-on-edge oriented silicon steel are important, and primary among these are core loss, interlaminar resistivity, space factor and magnetostriction.

It has long been recognized by prior art workers that the magnetic characteristics of cube-on-edge oriented silicon steel, and particularly those mentioned above, are enhanced if the silicon steel is provided with a surface film or glass which provides insulation to prevent wraps or laminations from "shorting" in a transformer. In the commercial manufacture of cube-on-edge oriented silicon steel, an annealing separator is used during the final anneal to which the silicon steel is subjected (i.e. that anneal during which the cube-on-edge orientation is achieved). When an appropriate annealing separator is used, as for example magnesia or magnesia-containing separators, a glass film is formed upon the surfaces of the silicon steel. This glass film is generally referred to in the industry as a "mill glass."

In some applications it is desirable to have an applied insulative coating rather than, or in addition to, the mill glass formed during the high temperature, orientation-determining anneal. This has led to the development of phosphate coatings, magnesium phosphate based coatings and aluminum phosphate based coatings, all of which produce an applied insulative coating on electrical steel when appropriately dried and cured.

U.S. Pat. Nos. 3,948,786 and 3,996,073 teach, respectively, means and method for the provision of improved insulative, tension-imparting coatings for electrical steel, with or without a mill glass base coating. The teachings of these patents are incorporated herein by reference. Briefly, these patents teach that excellent insulative coatings can be formed on electrical steels by applying thereto an aluminum-magnesium-phosphate solution containing $Al^{+++}$, $Mg^{++}$ and $H_2PO_4^-$ concentration in the following relative relationship on a water-free basis:

$AL^{+++}$ as $Al_2O_3$: 3–11% by weight
$Mg^{++}$ as MgO: 3–15% by weight
$H_2PO_4^-$ as $H_3PO_4$: 78–87% by weight The total weight percentages of these components must be 100 on a water-free basis.

A colloidal silica ($SiO_2$) solution may be added to the aluminum-magnesium-phosphate solution. If the concentration of $Al^{+++}$, $Mg^{++}$ and $H_2PO_4^-$ (again calculated as $Al_2O_3$, MgO and $H_3PO_4$, respectively) constitutes 100 parts by weight on a water-free basis, the colloidal silica will comprise from 0 to 150 parts by weight on a water-free basis. When colloidal silica is present, the total weight percent of $Al^{+++}$ (as $Al_2O_3$), $Mg^{++}$ (as MgO), $H_2PO_4^-$ (as $H_3PO_4$) and $SiO_2$ must be 100 on a water-free basis. At least 45% by weight of the solution is water. To the solution may be added chromic anhydride ($C_rO_3$) to stabilize the solution prior to application to the strip, to improve solution wettability and to improve moisture resistance of the final coatings and interlamination resistivity after stress relief anneal. The coating solutions of these references may be applied to silicon steels (with or without a mill glass base coating) in any suitable and conventional manner. The coated silicon steels will thereafter be subjected to a heat treatment to dry the solution and form the desired insulative glass film thereon.

The present invention constitutes an improvement upon the teachings of the above mentioned U.S. Pat. Nos. 3,948,786 and 3,996,073. In the commercial practice of these patents, it has been common procedure to provide a colloidal silica solution content of 50 volume percent with respect to the aluminum-magnesium-phosphate solution, hereinafter for convenience referred to as the "premix" solution. Thus, it has been preferred to use a coating solution having a premix solution to colloidal silica solution ratio of 1:1, i.e. a coating solution comprising 1 part premix solution by volume and 1 part colloidal silica solution by volume.

The present invention is based upon the discovery that optimum magnetics of the coated electrical steel are achieved when the coating solution contains colloidal silica in an amount of from that amount which will still permit the formation of a good glass, up to 40 volume percent colloidal silica solution (i.e. up to a 1.5:1 premix solution to colloidal silica solution). To achieve this, additional $Mg^{++}$ should be added to the solution up to that amount which will go into solution. To the premix solution should also be added from about 5 to about 20 parts boric acid ($H_3BO_3$) per 100 parts of $H_3PO_4$ on a water-free basis. Chromic anhydride ($C_rO_3$) is added to the premix to improve the wettability of the coating solution and to increase the moisture resistance of the resulting coating and interlaminar resistivity after stress relief anneal. The chromic anhydride addition also improves the appearance of the coating. It has further been found that with chromic anhydride present, more MgO will go into solution.

With the use of the improved coatings of the present invention, it has been found that better core loss values at inductions greater than 10 kg are achieved. Since colloidal silica is the most expensive ingredient of the coating solutions, reducing the volume percent of collodial silica will result in substantial cost savings. Furthermore, better coating adherence is achieved. The coatings of the present invention enable different top and bottom coating weights to be utilized, without adverse effects on magnetic quality. The coatings of the present invention are slightly rougher than those commercially achieved in accordance with the teachings of U.S. Pat. Nos. 3,996,073 and 3,948,786, which assists during the stacking of coated laminations in the manufacture of transformer cores and the like.

It has additionally been found that if the coating solutions of the present invention are diluted to form a uniform coating as thin as possible and having a coating weight of less than 2 grams per square meter on each side of the strip and preferably less than 1 gram per square meter on each side of the strip, they will, upon drying and curing, form excellent anti-stick coatings for non-oriented, semi-processed electrical steels.

DISCLOSURE OF THE INVENTION

In accordance with the invention there are provided improved insulative coatings for electrical steels and a method of making them. The coatings are hard, glassy and of excellent appearance. The coatings are easily cured, less expensive than prior art coatings having higher colloidal silica content, and demonstrate better adherence. Furthermore, electrical steels provided with the coatings of the present invention demonstrate improved magnetic characteristics.

The coatings of the present invention can be formed on electrical steels by applying thereto a solution comprising an aluminum-magnesium-phosphate premix solution containing an $Al^{+++}$, $Mg^{++}$ and $H_2PO_4^-$ concentration in the following relative relationship on a water-free basis:

$Al^{+++}$ as $Al_2O_3$: 3–11% by weight $Mg^{++}$ as MgO: 3–15% by weight $H_2PO_4^-$ as $H_3PO_4$: 78–87% by weight The total weight percentage of these components must be 100 on a water-free basis.

To the premix solution there is added colloidal silica solution in an amount of from that amount which will assure the formation of a glass up to 40 volume percent (i.e. up to a 1.5:1 premix solution to colloidal silica solution ratio).

To the premix is also added additional $Mg^{++}$ up to the maximum amount that will go into solution and from 5 to 20 parts $H_3BO_3$ per 100 parts $H_3PO_4$ on a water-free basis. At least 60% by weight of the solution is water.

Chromic anhydride is also added to the premix of the solutions of the present invention to improve their wettability and to improve the moisture resistance of the final coatings and interlaminar resistivity after stress relief anneal. Chromic anhydride should be added in an amount of from 10 to 45 parts per 100 parts $H_3PO_4$ on a water-free basis.

The coating solutions of the present invention may be applied to the silicon steels (with or without a mill glass base coating) in any suitable and conventional manner. The coated silicon steels will thereafter be subjected to a heat treatment to dry the solution and to form the desired insulative glass coating thereon.

The coating solutions of the present invention can be so diluted with water as to form uniform coatings as thin as possible and having a coating weight of less than 2 grams per square meter on each side of the strip and preferably less than 1 gram per square meter on each side of the strip. When applied to non-oriented, semi-processed electrical steels or other metallic surfaces and dried and cured, such coatings will form excellent anti-stick coatings, having excellent anti-stick characteristics during quality anneals or the like, and offering a small amount of surface insulation.

DETAILED DESCRIPTION OF THE INVENTION

As indicated above, for purposes of an exemplary showing the coatings of the present invention will be described in their application to cube-on-edge oriented silicon steel, it being understood that they are also applicable to carbon steels for electrical uses, non-oriented silicon steels, and silicon steels of various orientations.

Cube-on-edge oriented silicon steel normally has a mill glass formed thereon during the process of its manufacture and the coatings of the present invention may be applied over such mill glass, or they may be applied to the bare metal, the mill glass base coating having been removed.

If the coatings of the present invention are to be applied over a mill glass formed during the high temperature anneal of the silicon steel (i.e. that anneal in which the secondary grain growth occurs producing the desired cube-on-edge orientation), it is only necessary to remove excess annealing separator from the steel surface by scrubbing, light pickling or the like. If it is desired to apply the coatings of the present invention to the bare metal surface of the silicon steel, the mill glass formed during the high temperature anneal must be removed by hard pickling or other appropriate and well known procedures. Where no mill glass is desired, special annealing separators have been developed which produce a more easily removable mill glass or no mill glass at all.

The coatings of the present invention are achieved by applying to an electrical steel an aqueous solution. The solution comprises a premix solution in the form of an aluminum-magnesium-phosphate solution containing $Al^{+++}$, $Mg^{++}$, and $H_2PO_4^-$. To this premix there is added additional $Mg^{++}$, boric acid, colloidal silica, and chromic anhydride.

The colloidal silica solution content of the coating solution may vary from that amount which will provide a good glass up to about 40% by volume of the coating solution. This provides a coating solution having a premix solution to colloidal silica solution ratio of up to 1.5:1. This upper limit of 40% by volume is based upon the discovery that (at this ratio) cube-on-edge oriented silicon steel, provided with an insulative coating dried and cured from such a solution, will demonstrate optimum magnetic characteristics and, in particular, improved core loss values at inductions greater than 10 kg. It has additionally been discovered that as the amount of colloidal silica is further reduced in the coating solution, the magnetic characteristics of cube-on-edge oriented silicon steel with coatings formed from such solutions do not further improve, but remain at the improved level achieved with a premix solution to colloidal silica solution ratio of 1.5:1.

While it is believed that some colloidal silica should be present in the coating solutions to provide the best achievable glass-like insulating coatings, reducing the volume percent of colloidal silica used results in substantial cost savings. In the practice of the present invention, excellent coatings and excellent magnetic characteristics of the coated cube-on-edge oriented silicon steel have been achieved with coating solutions having premix solution colloidal silica solution ratios of 1.5:1, 2:1, 3:1 and 4:1.

On a water-free basis, the colloidal silica addition can be stated in terms of parts $SiO_2$ per 100 parts $H_3PO_4$. Thus, for coating solutions having premix solution to colloidal silica volume ratios of 1.5:1, 2:1, 3:1 and 4:1, the collodial silica additions on a water-free basis can be stated respectively as 70.5, 53.0, 35.3, and 26.4 parts per 100 parts $H_2PO_4^-$ calculated as $H_3PO_4$, on a water-free basis.

As calculated on a water-free basis, the weight percents of $Al^{+++}$ (as $Al_2O_3$), $Mg^{++}$ (as MgO) and $H_2PO_4^-$ (as $H_3PO_4$) will depend upon the $SiO_2$ content by the following formulae:

$$Al^{+++} \text{ (as } Al_2O_3) = [3 \text{ to } 11\%] \frac{100\% - \% \, SiO_2}{100\% \, SiO_2}$$

$$Mg^{++} \text{ (as MgO)} = [3 \text{ to } 15\%] \frac{100\% - \% \, SiO_2}{100\% \, SiO_2}$$

$$H_2PO_4^- \text{ (as } H_3PO_4) = [78 \text{ to } 87\%] \frac{100\% - \% \, SiO_2}{100\% \, SiO_2}$$

where the total weight of $SiO_2$, $Al^{+++}$ as ($Al_2O_3$), $Mg^{++}$ (as MgO), and $H_2PO_4^-$ as ($H_3PO_4$) is equal to 100.

The above statements concerning colloidal silica are based on the use of a colloidal silica solution comprising about 35% by weight colloidal silica, the balance being water. Colloidal silica solutions comprising from about 20% to about 40% by weight colloidal silica, the balance being water, can be used. Colloidal silica solutions meeting these specifications are commercially available. The composition of the colloidal silica solution may have a bearing on the shelf life of the coating solution of the present invention. Excellent results have been achieved through the use of LUDOX TYPE AS, sold by E. I. DuPont de Nemours & Co., Inc., Industrial Chemicals Department, Industrial Specialties Division, Wilmington, Del. 19898. LUDOX is a registered trademark of E. I. DuPont de Nemours & Co., Inc. Excellent results have also been achieved through the use of NALCOAG-6034, sold by Nalco Chemical Co., Chicago, Ill. NALCOAG is a registered trademark of Nalco Chemical Co.

It has been found that with colloidal silica present in the coating solution in the range taught above, there is a tendency (if the coating is cured in the mill in a conventional roller hearth furnace) for the coating to stick and accumulate on the furnace rolls during curing, or for the coating to stick during a stress relief anneal. Furthermore, the dried and cured coatings have a poor, milky, non-uniform and powdery physical appearance and tend to be hygroscopic.

To overcome these problems, additional $Mg^{++}$ is added to the premix solution by additions of MgO, magnesium nitrate or magnesium acetate. The $Mg^{++}$ additions may be up to that amount which will go into solution. While the increased $Mg^{++}$ concentration improves the physical appearance of coatings made from these solutions, the coatings may still demonstrate a slightly milky appearance and may still be characterized by a slight sticking after a stress relief anneal (for example at 1500° F. in a 95% nitrogen and 5% hydrogen atmosphere). Thus increasing the $Mg^{++}$ concentration alone will not completely solve the problems. To improve the glass forming reactions and physical appearance of the coating, from about 5 to about 20 parts of boric acid ($H_3BO_3$), vanadium pentoxide ($V_2O_5$), or mixtures thereof, are added to the premix solution per 100 parts $H_2PO_4^-$ calculated as $H_3PO_4$ on a water-free basis. This addition of boric acid, vanadium pentoxide, or mixtures thereof, in combination with the addition of $Mg^{++}$ added to the premix solution, produces an insulative coating which is glassy, uniform in appearance and characterized by excellent adherence. The coated cube-on-edge silicon steel demonstrates improved core loss values at inductions greater than 10 kg. It has been found that additions of boric acid, vanadium pentoxide, or mixtures thereof, less than about 5 parts per 100 parts $H_3PO_4$, will not improve coating appearance, while additions of more than about 20 parts per 100 parts $H_3PO_4$ are very difficult to get into solution.

Finally, chromic anhydride ($C_rO_3$) is added to the premix to improve wettability and stability of the solution, to decrease the hygroscopic tendency of the final coating and improve its interlaminar resistivity after stress relief anneal. The chromic anhydride is added in an amount of from 10 to 45 (and preferably 25 to 35) parts by weight for every 100 parts by weight of $H_2PO_4^-$ calculated as $H_3PO_4$ on a water-free basis. With chromic anhydride additions, the MgO addition to the premix solution can be slightly higher.

The coating solution of the present invention may be applied to the cube-on-edge oriented silicon steel in any suitable manner including spraying, dipping or swabbing. Metering rollers and doctor means may also be used. Whether the coating solutions of the present invention are to be applied to silicon steel having a mill glass, or bare silicon steel, the surface of the steel to be coated should be free of oils, greases and scale.

The coating solutions of the present invention should contain at least 60% water. They may be as dilute as desired for controlled application to the surfaces of the electrical steel sheet or strip. The upper limit of the percentage of the total solution weight as water is dictated only by the desired coating weight or insulation desired and the coating method used and can be readily ascertained by one skilled in the art to meet his particular needs.

After coating, the silicon steel is subjected to a heat treatment to dry and cure the coating solution thereon to form the desired insulative coating. The drying or curing step may be performed at a temperature of from about 700° F. (371° C.) to about 1600° F. (870° C.) for from about ½ to 3 minutes in an appropriate atmosphere such as air. It is also within the scope of the invention to perform the drying or curing step as a part of another heat treatment, such as a conventional flattening heat treatment.

The coatings of the present invention (if diluted to form a uniform coating as thin as possible and having a coating weight of less than 2 grams per square meter on each side of the strip and preferably less than 1 gram per square meter on each side of the strip) may serve as improved inorganic anti-stick coatings for non-oriented, semi-processed electrical steels. Such anti-stick coatings are hard, thin coatings of excellent and uniform appearance, capable of withstanding quality anneal temperatures up to at least 1650° F. (900° C.) and do not interfere with decarburization during quality anneal. At a coating weight below about 0.1 gram per square meter on each side of the strip, a continuous coating may be difficult to obtain.

The term "non-oriented, semi-processed electrical steels, " as used herein and in the claims, is intended to refer to those electrical steels known in the art as "semi-processed" since they have not been processed at the mill to fully develop magnetic properties. The customer must complete the processing by proper annealing. This necessary annealing involves grain growth and decarburization (depending upon the amount of decarburization accomplished in the mill), both of which are essential to development of optimum magnetic properties.

Such steels include cold rolled, non-oriented, semi-processed silicon steels, cold rolled, semi-processed carbon steels for motor laminations and the like, and semi-processed, low-oxygen silicon bearing lamination steels of the type taught in U.S. Pat. No. 3,867,211.

Copending United States application Ser. No. 251,136 filed, Apr. 6, 1981 in the names of Michael H. Haselkorn and James D. Evans and entitled A METHOD OF PROVIDING AN ANTI-STICK COATING ON NON-ORIENTED, SEMI-PROCESSED ELECTRICAL STEELS TO BE SUBJECTED TO A QUALITY ANNEAL, the subject matter of which is incorporated herein by reference, teaches certain anti-stick coatings. In accordance with the above mentioned copending application, a coating solution containing $Al^{+++}$, $Mg^{++}$ and $H_2PO_4^-$ in a specified relative relationship is applied to the non-oriented, semi-processed electrical steels. The concentration of $Al^{+++}$, $Mg^{++}$ and $H_2PO_4^-$ is 100 parts by weight calculated as $Al_2O_3$, MgO and $H_3PO_4$, respectively, on a water-free basis. The coating solution may contain from 0 to 150 parts by weight of colloidal silica on a water-free basis. In addition, chromic anhydride ($C_rO_3$) may optionally be added to the solutions. The coating solutions are thereafter so diluted as to provide a uniform coating as thin as possible and having a coating weight of less than 2 grams per square meter per side of the strip, and preferably less than 1 gram per square meter per side of the strip.

The coating solutions of the present invention, when intended to serve as anti-stick coatings, can be applied to a non-oriented, semi-processed electrical steel in any of the ways described above with respect to the application of the solutions of the present invention to cube-on-edge oriented silicon steel. The coated non-oriented, semi-processed electrical steel is subjected to a heat treatment to dry and cure the coating solution thereon to form the desired anti-stick coating. The coating solution is applied to the electrical steel with the electrical steel being at room temperature, or at a temperature below the boiling point of the solution. The heat treatment to cure and dry the solution is accomplished at a strip temperature of from about 700° F. (371° C.) to about 1600° F. (870° C.) and preferably from about 800° F. (427° C.) to about 850° F. (454° C.). The heat treatment is conducted in any appropriate atmosphere such as air (if below about 1200° F. or 649° C.), nitrogen, hydrogen or nitrogen - hydrogen mixtures. The heat treatment is conducted for a period of time sufficient to dry and cure the coating solution on the electrical steel.

EXAMPLE I

To demonstrate the effects of colloidal silica solution content of the coating solution on the magnetic quality of the coated cube-on-edge oriented silicon steel, four coating solutions were applied to material taken from coils of regular grain oriented, 11 mil, silicon steel having a mill glass. Prior to coating with the solutions of the present invention, the silicon steel was subjected to a stress-relief anneal at 1500° F. (816° C.) for 3 hours in a 95% nitrogen - 5% hydrogen atmosphere. Thereafter the magnetic properties were measured.

The coating solutions used and their compositions are given below. In all of the coating solutions the premix comprised 8.8% $Al^{+++}$ (as $Al_2O_3$), 7.5% $Mg^{++}$ (as MgO) and 83.7% $H_2PO_4^-$ (as $H_3PO_4$). In all of the coating solutions the premix contained 25 parts chromic anhydride ($C_rO_3$) per 100 parts $H_3PO_4$. In all of the coating solutions a 35% colloidal silica solution was used.

Coating A—premix and colloidal silica solutions in a ratio of 1:1.

Coating B—200 ml premix solution + 100 ml colloidal silica solution + 3.3 gm MgO/100 ml premix solution (6.6 gm MgO) and 4.5 gm $H_3BO_3$/100 ml premix solution (9.0 gm $H_3BO_3$), diluted to a specific gravity of 1.3.

Coating C—240 ml premix solution + 80 ml. colloidal silica solution + 3.3 gm MgO/100 ml premix solution (7.92 gm MgO) + 4.5 gm $H_3BO_3$/100 ml premix solution (10.8 gm $H_3BO_3$), diluted to a specific gravity of 1.3.

Coating D—200 ml premix solution + 50 ml colloidal silica solution + 4.0 gm. MgO/100 ml premix solution (8.0) gm MgO + 4.5 gm $H_3BO_3$/100 ml premix solution (9.0 gm $H_3BO_3$), diluted to a specific gravity of 1.3 ml premix solution (10.8 gm $H_3BO_3$), diluted to a specific gravity of 1.3.

Coating D—200 ml premix solution + 50 ml colloidal silica solution + 4.0 gm. MgO/100 ml premix solution (8.0 gm MgO) + 4.5 gm $H_3BO_3$/100 ml premix solution (9.0 gm $H_3BO_3$), diluted to a specific gravity of 1.3.

It will be evident that coating solutions A,B,C and D had premix solution to colloidal silica solution ratios of 1:1, 2:1, 3:1 and 4:1, respectively. The coatings were applied with grooved rolls and the coated samples were subjected to a heat treatment at 800° F. (427° C.), for 75 seconds in air to dry the coatings. Then the coated samples were subjected to a heat treatment at 1500° F. (816° C.) for 75 seconds in air to cure the coatings.

Thereafter, the coated samples were subjected to a second stress relief anneal at 1500° F. (816° C.) in a 95% nitrogen - 5% hydrogen atmosphere for 3 hours.

The samples were again tested for magnetic quality. The magnetic test results are summarized in Table I. A negative value in Table I corresponds to an improvement in core loss after coating.

TABLE I

| | Change in Core Loss (Δw/lb) at 60Hz Glass Film Weights Coated Weights | | | | Change In Franklin Resistivity in AMPS After Second Stress Relief Anneal |
|---|---|---|---|---|---|
| Coating | B=15 | B=17 | B=15 | B=17 | |
| A (1:1) | −0.005 | −0.012 | −0.001 | 0 | +0.220 |
| B (2:1) | −0.009 | −0.023 | −0.005 | −0.013 | +0.154 |

TABLE I-continued

| Coating | Change in Core Loss (Δw/lb) at 60Hz Glass Film Weights Coated Weights B=15 | B=17 | B=15 | B=17 | Change In Franklin Resistivity in AMPS After Second Stress Relief Anneal |
|---|---|---|---|---|---|
| C (3:1) | −0.012 | −0.026 | −0.008 | −0.014 | +0.124 |
| D (4:1) | −0.014 | −0.025 | −0.010 | −0.016 | +0.134 |

The coating weights measured on Epstein samples ranged from 6.1 to 6.8 gm/m$^2$ per side. The resistivity test formed on two Epstein samples per coating, 6 tests per sample.

The results of this example indicate that there is a significant improvement in core loss (B=15 and B=17 kg.) when the colloidal silica content is reduced from a 1:1 premix solution to colloidal silica solution ratio to a 2:1 premix solution to colloidal silica solution ratio. Further reductions in colloidal silica, however, do not change the core loss significantly. Similar tests have shown that a similar improvement in core loss is achieved with a coating solution having a premix solution to colloidal silica solution ratio of 1.5:1.

While not wishing to be bound by theory, it is believed that this improvement in magnetic quality at lower colloidal silica levels occurs because the low colloidal silica coatings impart more tension on the steel strip. It has further been determined that even if no MgO or $H_3BO_3$ additions are made to the low colloidal silica coatings (having a premix to colloidal silica ratio of 1.5:1 or less) to improve coating appearance, a magnetic quality improvement of the same magnitude as with MgO and $H_3BO_3$ additions is still obtained.

EXAMPLE II

Again, four coating solutions were mixed and applied to samples taken from a coil of regular grain oriented, 11 mill, silicon steel, which had been subjected to a stress-relief anneal and tested for magnetic quality as described in Example I. The coating solutions and their compositions are given below. In all of the coating solutions the premix solutions (including chromic anhydride content) were the same as that described in Example I and in all of the coating solutions the same 35% colloidal silica solution was used.

Coating H—premix and colloidal silica solutions in a ratio of 1:1.

Coating I—premix and colloidal silica solutions in a ratio of 2:1.

Coating J—premix solution+2.0 gm MgO/100 ml of premix solution+colloidal silica solution with a premix solution to colloidal silica solution ratio of 2:1.

Coating K—premix solution+2.5% $H_3BO_3$ (3.5 gm $H_3BO_3$/100 ml premix solution)+3.3 gm MgO/100 ml premix solution+colloidal silica solution with a premix solution to colloidal silica solution ratio of 2:1.

The coating samples were heat treated to dry and cure the coating in the manner described in Example I. The coating weight was approximately 6.5 gm/m$^2$ per side for all samples. All of the samples were subjected to a second stress relief anneal at 1500° F. (816° C.) for 3 hours in an atmosphere of 95% nitrogen - 5% hydrogen. The magnetic qualities of the samples were again determined. The magnetic test results are shown in Table II below.

TABLE II

| Coating | Core Loss (Δw/lb at 60Hz) Glass Film Weight Coated Weight B=15 | B=17 | B=15 | B=17 |
|---|---|---|---|---|
| H | +.006 | +.004 | +.011 | +.020 |
| I | +.002 | −.005 | +.008 | +.007 |
| J | +.001 | −.006 | +.007 | +.007 |
| K | +.001 | −.005 | +.007 | +.009 |

Again the results indicate that reducing the amount of colloidal silica improves the core loss. While the samples coated with coating H had a good, uniform, glossy coating appearance, with no sticking during the stress relief anneal, the samples coated with coating I had a white, powdery, non-uniform appearance and demonstrated severe sticking problems, even through the magnetic properties of these samples were better than those coated with coating H. Samples coated with coating K (containing additions of MgO and $H_3BO_3$) demonstrated an excellent, uniform and glossy coating appearance with no sticking during the stress relief anneal. The samples coated with coating J (containing addition of MgO only) were better than those with coating I, demonstrating less sticking during the stress relief anneal. However, the coating of these samples were slightly powdery and slightly rougher and less glossy than the coating of samples provided with coating K. This indicates that boric acid promotes glass formation.

EXAMPLE III

Six coating solutions were prepared and each coating solution was applied to samples taken from three different coils of 11 mil cube-on-edge oriented silicon steel. In all of the coating solutions the premix solution (including the chromic anhydride content) and the colloidal silica solution used were the same as those used in Example I. The coating solution compositions are given as follows:

Coating P—300 ml premix solution+100 ml colloidal silica solution diluted to a specific gravity of 1.3 and having a premix solution to coating solution ratio of 3:1.

Coating Q—200 ml premix solution+50 ml colloidal silica solution diluted to a specific gravity of 1.3 and having a premix solution to coating solution ratio of 4:1.

Coating R—300 ml premix solution+100 ml colloidal silica solution+3.3 gm MgO/100 ml premix solution (9.9 gm. MgO)+4.5 gm $H_3BO_3$/100 ml premix solution (13.5 gm $H_3BO_3$) diluted to a specific gravity of 1.3 and having a premix solution to colloidal silica solution ratio of 3:1.

Coating S—200 ml premix solution+50 ml colloidal silica solution+3.3 gm MgO/100 ml premix solution (6.6 gm. MgO)+4.5 gm $H_3BO_3$/100 ml premix solution (9.0 gm. $H_3BO_3$) diluted to a specific gravity of 1.3 and having a premix solution to colloidal silica solution ratio of 4:1.

Coating T—300 ml premix solution+100 ml colloidal silica solution+4.4 gm. MgO/100 ml premix solution (13.2 gm MgO)+4.5 gm $H_3BO_3$/100 ml premix solution (13.5 gm $H_3BO_3$) diluted to a specific gravity of 1.3 and having a premix solution to colloidal silica solution ratio of 3:1.

Coating U—200 ml premix solution+100 ml colloidal silica solution+3.3 gm. MgO/100 ml premix solution (6.6 gm MgO)+4.5 gm $V_2O_5$/100 ml premix solution (9.0 gm $V_2O_5$) diluted to a specific gravity of 1.3 and having a premix solution of colloidal silica solution ratio of 2:1.

All of the coating solutions P-U coated well, except that coating solution T was a suspension rather than a solution due to the presence of excess MgO. In coating solution U, not all of the $V_2O_5$ went into solution. The coating solutions were applied to the samples and cured in the manner described with respect to Example I. The samples coated with coating solution P (having a 3:1 premix solution to colloidal silica solution ratio) were white, powdery, and non-uniform in appearance having a tendency to bubble during the curing step. Those samples coated with coating solution Q (having a 4:1 premix to colloidal silica solution ratio) were more white, powdery and non-uniform in appearance. On the other hand, those samples coated with coating solutions R and S (having 3:1 and 4:1 premix solution to colloidal silica solution ratios, respectively) were greatly improved due to the additions of MgO and $H_3BO_3$. Samples coated with coating solution R had a good, clear, glossy appearance. Samples coated with coating solution S had a coating appearance considered good but somewhat more turbid and whiter than those samples coated with coating solution R. The samples coated with coating solution T (having a premix solution to colloidal silica solution ratio of 3:1) were rough, non-uniform and had a matt appearance. This demonstrates that too much MgO can be added, not all of the MgO having gone into solution. The samples coated with coating solution U (containing MgO and $V_2O_5$ additions and having a premix solution to colloidal silica solution ratio of 2:1) had a coating appearance which was uniform, slightly glossy and of a definite green tint. The coatings of these samples were characterized by especially good adherence.

Modifications may be made in the invention without departing from the spirit of it.

What is claimed is:

1. An aqueous coating solution for forming an insulative coating directly on electrical steels and on steels having a mill glass thereon, said coating solution comprising a premix solution and a colloidal silica solution, said premix solution containing an $Al^{+++}$, $Mg^{++}$ and $H_2PO_4^-$ concentration in the following relative relationship on a water-free basis: from 3 to 11% by weight $Al^{+++}$ calculated as $Al_2O_3$, from 3 to 15% by weight $Mg^{++}$ calculated as MgO, and 78 to 87% by weight $H_2PO_4^-$ calculated as $H_3PO_4$, the total weight percentage of $Al^{+++}$ (as $Al_2O_3$), $Mg^{++}$ (as MgO) and $H_2PO_4^-$ (as $H_3PO_4$) being 100% on a water-free basis, said concentration of $Al^{+++}$, $Mg^{++}$ and $H_2PO_4^-$ comprising 100 parts by weight calculated as $Al_2O_3$, MgO and $H_3PO_4$ respectively on a water-free basis, said premix also comprising from about 10 to about 45 parts by weight $C_rO_3$ for every 100 parts by weight $H_2PO_4^-$ calculated as $H_3PO_4$ on a water-free basis, from about 5 to about 20 parts of a compound chosen from the class consisting of boric acid, vanadium pentoxide and mixtures thereof per 100 parts $H_2PO_4^-$ calculated as $H_3PO_4$ on a water-free basis and additional $Mg^{++}$ up to that amount which will go into solution, said colloidal silica solution being present in an amount of from that amount which will form a good glass up to 40 volume percent to provide a coating solution having a premix solution to colloidal silica solution volume ratio up to 1.5:1.

2. The coating solution claimed in claim 1 wherein at least 60% by weight of said coating solution is water.

3. The coating solution claimed in claim 1 wherein said premix solution to colloidal silica solution volume ratio is 2:1.

4. The coating solution claimed in claim 1 wherein said premix solution to colloidal silica solution volume ratio is 3:1.

5. The coating solution claimed in claim 1 wherein said premix solution to colloidal silica solution volume ratio is 4:1.

6. The coating solution claimed in claim 1 wherein $C_rO_3$ is present in said premix in an amount of from about 25 to about 35 parts by weight for every 100 parts by weight $H_2PO_4^-$ calculated as $H_3PO_4$ on a water-free basis.

7. The coating solution claimed in claim 1 so diluted with water as to provide a uniform continuous coating having a coating weight of less than about 2 grams per square meter per side of said electrical steel.

8. The coating solution claimed in claim 1 so diluted with water as to provide a uniform continuous coating having a coating weight of less than about 1 gram per square meter per side of said electrical steel.

9. The coating solution claimed in claim 1 wherein said premix solution to colloidal silica solution volume ratio is from 4:1 to 1.5:1.

10. A process of providing an insulative coating directly on electrical steel and steel having a mill glass thereon comprising the steps of applying to said steel a coating solution comprising a premix solution and a colloidal silica solution, said premix solution containing an $Al^{+++}$, $Mg^{++}$ and $H_2PO_4^-$ concentration in the following relative relationship on a water-free basis: from 3 to 11% by weight $Al^{+++}$ calculated as $Al_2O_3$, from 3 to 15% by weight $Mg^{++}$ calculated as MgO, and 78 to 87% by weight $H_2PO_4^-$ calculated as $H_3PO_4$, the total weight percentage of $Al^{+++}$ (as $Al_2O_3$), $Mg^{++}$ (as MgO) and $H_2PO_4^-$ (as $H_3PO_4$) being 100% on a water-free basis, said concentration of $Al^{+++}$, $Mg^{++}$ and $H_2PO_4^-$ comprising 100 parts by weight calculated as $Al_2O_3$, MgO and $H_3PO_4$ respectively on a water-free basis, said premix also comprising from about 10 to about 45 parts by weight $C_rO_3$ for every 100 parts by weight $H_2PO_4^-$ calculated as $H_3PO_4$ on a water-free basis, from about 5 to about 20 parts of a compound chosen from the class consisting of boric acid vanadium pentoxide and mixtures thereof, per 100 parts $H_2PO_4^-$ calculated as $H_3PO_4$ on a water-free basis and additional $Mg^{++}$ up to that amount which will go into solution, said colloidal solution being present in an amount of from that amount which will form a good glass up to 40 volume percent to provide a coating solution having a premix solution to colloidal silica solution ratio up to 1.5:1, and subjecting said coated steel to a heat treatment to cure said coating.

11. The process claim in claim 10 wherein at least 60% by weight of said coating solution is water.

12. The process claimed in claim 10 wherein said premix solution to colloidal silica solution ratio is 2:1.

13. The process claimed in claim 10 wherein said premix solution to colloidal silica solution ratio is 3:1.

14. The process claimed in claim 10 wherein said premix solution to colloidal silica solution ratio is 4:1.

15. The process claimed in claim 10 wherein said $C_rO_3$ is present in said premix in an amount of from about 25 to about 35 parts by weight for every 100 parts by weight $H_2PO_4^-$ calculated as $H_3PO_4$ on a water-free basis.

16. The process claimed in claim 10 including the step of diluting said coating solution with water so as to provide a uniform coating having a coating weight less than about 2 grams per square meter per side of said electrical steel.

17. The process claimed in claim 10 including the step of diluting said coating solution with water so as to provide a uniform coating having a coating weight less than about 1 grams per square meter per side of said electrical steel.

* * * * *